US007488166B2

(12) United States Patent
Snyders

(10) Patent No.: US 7,488,166 B2
(45) Date of Patent: Feb. 10, 2009

(54) ROTARY VOLUMETRIC MACHINE

(76) Inventor: Rene Snyders, Les Hameaux de Valbonne, Villa 38, 704 Route d'Antibes, Valbonne (FR) 06640

( * ) Notice: Subject to any disclaimer, the term of this patent is extended or adjusted under 35 U.S.C. 154(b) by 794 days.

(21) Appl. No.: 10/497,303

(22) PCT Filed: Nov. 27, 2002

(86) PCT No.: PCT/FR02/04053

§ 371 (c)(1),
(2), (4) Date: Jun. 1, 2004

(87) PCT Pub. No.: WO03/046388

PCT Pub. Date: Jun. 5, 2003

(65) Prior Publication Data

US 2005/0019197 A1 Jan. 27, 2005

(30) Foreign Application Priority Data

Nov. 30, 2001 (FR) ..... 01 15468

(51) Int. Cl.
*F03C 4/00* (2006.01)
*F04C 18/00* (2006.01)

(52) U.S. Cl. ..... 418/248; 418/212; 418/243; 418/251

(58) Field of Classification Search ..... 418/248, 418/210, 212, 215, 243, 251
See application file for complete search history.

(56) References Cited

U.S. PATENT DOCUMENTS 2,821,176 A * 1/1958 Koser et al. ..... 418/248
2,845,872 A 8/1958 Farron et al.
3,810,724 A 5/1974 Luukkonen

FOREIGN PATENT DOCUMENTS

| | | | |
|---|---|---|---|
| CH | 657665 | A5 * | 9/1986 |
| DE | 24 30 928 | | 11/1976 |
| FR | 1 439 516 | | 5/1966 |
| FR | 2 005 244 | | 12/1969 |
| FR | 2 807 792 | | 10/2001 |
| GB | GB 2 254 888 | | 10/1992 |
| JP | 63176685 | A * | 7/1988 |
| JP | 01024195 | A * | 1/1989 |
| JP | 02086983 | A * | 3/1990 |
| WO | WO 8501776 | A1 * | 4/1985 |
| WO | WO 00/73627 | | 12/2000 |

* cited by examiner

*Primary Examiner*—Theresa Trieu
(74) *Attorney, Agent, or Firm*—Young & Thompson

(57) ABSTRACT

A rotary volumetric machine includes a stator in which a cylindrical chamber is provided, a rotor disposed therein and secured to a shaft, blades formed on the rotor, and abutments movable by actuating elements between an extended position into the volume of the cylindrical chamber during the working phase so as to generate variations of volume between the blades and the abutments, and a position retracted into the stator to permit the passage of the blades from one side to the other of the abutments. The rotor includes a disc, two concentric shoulders disposed on opposite sides of the disc and two fixed blades disposed diametrically opposite on opposite sides of the disc each against one surface thereof and secured to the periphery of a shoulder so as to obtain an assembly balanced in rotation.

13 Claims, 19 Drawing Sheets

ROTARY VOLUMETRIC MACHINE

This is a 371 National Stage application of PCT/FR02/04053, filed Nov. 27, 2002, and claims priority to French application FR 0115468, filed Nov. 30, 2001; the contents of the above applications are incorporated herein.

The present invention relates to a rotary volumetric machine which is not segmented, whose components take part in the creation of the variation of the volumes, mainly with or without variation of pressure, are not subjected to any friction, the working volume being free from any form of lubrication, the sealing being obtained by controlled pressure drop whilst a motor couple can be directly generated.

BACKGROUND OF THE INVENTION

There exist, at least on paper, rotary volumetric machines of the type comprising a stator in which a chamber of suitable shape is provided, a rotor secured to a shaft being disposed in said chamber whilst the movable elements of the blade type ensure variations of volume, these machines can be roughly divided into the following families:

a family of machines in which the blades move radially in the rotor, which is represented among other documents by the patents FR-A-2806751, FR-A-2792364, WO-A-0109485, WO-A-0057027, WO-A-0052306, WO-A-0023692, EP-A-1043504, EP-A-1001172, EP-A-1118773, FR-A-2807792, EP-A-1043503, EP-A-1035327, EP-A-1008753, WO-A-9911907, WO-A-0055478, GB-A-744247, EP-A-1055823, WO-A-0075517 and DE-A-19815093;

generally speaking, the machines of this family have it in common:

that they have more than one blade per rotor, which limits the ratio between the greatest and the least volume comprised between the blades, that the movable elements are subject to centrifugal force generated by the rotation of the rotor and are applied with more or less force against the interior wall of the stator, which gives rise to more or less great friction and contact pressure, that said friction must be lubricated, which does not permit this type of machine to operate dry, nor at high temperatures;

a family of machines in which the blades are articulated in the rotor, which is represented among other documents by the patents WO-A-9961752, WO-A-9857039, WO-A-0111196, WO-A-0120132 and U.S. Pat. No. 4,451,215;

generally speaking, the machines of this family have in common:

that they have more than one blade per rotor, which limits the ratio between the greatest and least volume comprised between the blades, that the movable elements are subject to centrifugal force generated by rotation of the rotor, even if mechanical devices which are either of one piece with the rotor, or bodies with the rotor limiting the friction pressure, the clearance due to tolerances of machining or wear giving rise sooner or later to greater or lesser friction and contact pressures, that said friction must be lubricated, which does not permit this type of machine to run dry, nor at high temperatures;

a family of machines in which the blades are articulated in the rotor and in the stator, which is represented among other documents by the patents U.S. Pat. Nos. 1,253,460, 1,886,206 and WO-A-0075517;

generally speaking, the machines of this family have it in common:

that they have more than one blade per rotor, which limits the ratio between the least and greatest volume comprised between the blades, that the articulations are disclosed in the working volume, that there must be lubricated and that because of this, the machines cannot run dry nor at high temperatures;

a family of machines in which the blades are articulated in the stator, which is represented among other documents by the patents U.S. Pat. No. 4,772,185 and EP-A-0120993;

generally speaking, the machines of this family have it in common:

that they have more than one blade per rotor, which limits the ratio between the least and greatest volume comprised between the blades, that the articulations are disposed in the working volume, which must be lubricated and accordingly these machines cannot run dry nor at high temperatures;

that the blades are maintained applied against the rotor with the help of springs, which does not permit using these machines at high temperatures;

a family of machines in which the blades are articulated in the rotor, whilst elements of the abutment type form a body with the stator, which is represented among other documents by the patent WO 01/46561; generally speaking, the machines of this family have it in common:

that they have more than one blade per rotor, which limits the ratio between the greatest and least volume comprised between the blades;

that the movable elements are subject to centrifugal force generated by rotation of the rotor and are applied with more or less force against the internal wall of the stator, which gives rise to more or less great contact pressures and friction;

that the articulations are disposed in the working volume and that because these articulations must be lubricated, these machines cannot run dry nor at high temperatures;

that the blades, according to the speed of rotation, enter into more or less violent contact with said abutments, which can give rise not only to undesirable noise, but above all the rapid degradation of the portions that must assure sealing;

a family of machines in which the elements of the blade type are of one piece with the rotor whilst the elements in the nature of abutments are articulated in the rotor, which is represented among other documents by the patent WO 00/73627;

generally speaking, the machines of this family have it in common:

that they have more than one blade per rotor, which limits the ratio between the greatest and least volume comprised between the blades;

that the abutments are maintained applied against the rotor with the help of springs, which does not permit using these machines at high temperatures;

that the articulations are disposed in the working volume and that because of this, said articulations must be lubricated, so that these machines cannot run dry nor at high temperatures;

that the blades, according to the speed of rotation, enter into more or less violent contact with said abutments, which can give rise not only to undesirable noise but above all the rapid degradation of the parts that must ensure sealing.

Finally, there is known from GB 2254888 a pump or motor with a rotatable piston in which a flap can be moved between a retracted position and an extended position in the working cylinder. The flap comes into contact against a rotor element to produce the separation into two zones of the volume of the working cylinder. As the flap wears, the contact surfaces must be lubricated, which does not permit this machine to operate dry at high temperatures.

Generally speaking, the machine according to the present application, permits overcoming one or several of the mentioned drawbacks.

BRIEF SUMMARY OF THE INVENTION

The present invention relates to a rotary volumetric machine comprising a stator in which a cylindrical chamber is provided, a rotor disposed in the cylindrical chamber and secured to a shaft, blades formed on the rotor, and abutments movable by actuating means between:

- a position extended into the volume of the cylindrical chamber during the working phase so as to generate variations of volume between the blades and the abutments;
- a position retracted into the stator to permit the passage of the blades from one side to the other of the abutments;

characterized by the fact that:

- the rotor comprises a disc, two concentric shoulders disposed on opposite sides of said disc and two fixed blades disposed diametrically opposite on opposite sides of said disc, each against a surface of said disc and secured to the periphery of a shoulder so as to obtain an assembly that is balanced in rotation;
- in the position extended into the volume of the cylindrical chamber, the abutments are positioned adjacent, but out of contact with, the shoulders.

According to preferred modifications:

- the dimensions of the surfaces of the rotor associated with the surfaces of the stator, the dimensions of the surfaces of the abutments associated with the surfaces of the rotor and of the stator, the clearance between the surfaces of the associated rotor and stator, the clearance between the surfaces of the abutments and the surfaces of the associated rotor and stator, the arithmetic roughness of all the associated surfaces, are defined such that they generate turbulences in said clearances, permitting obtaining a sealing by controlled pressure drop so as not to have friction nor the need for lubrication in these places;
- the ridges which define the periphery of the different surfaces are left sharp or are only slightly rounded, to disturb the passage of the fluids in said clearances;
- the rotor is positioned axially on the one hand between the covers of the stator secured to the stator and on the other hand between rollers with the help of partitions whose length is defined according to the specification, so that the rotor can turn without entering into contact with said covers;
- actuating means for the movable abutments are disposed at a distance from the cylindrical chamber;
- the abutments are carried by an axle disposed at a distance from said cylindrical chamber, they swing under the action of actuating means, such that the bearing pressure will be borne by said axle, the external side being preferably the high pressure side and the lateral side the low pressure side, the articulation of said abutment about said axle being thus lubricated independently without influence without inflow into the interior of said cylindrical chamber;
- each swinging abutment is controlled by a hydraulic or pneumatic jack articulated in the stator to be able to follow the curve of the arc of the circle defined by the angular movement of its point of securement on said swinging abutment, so as to limit the number of friction points;
- each swinging abutment is controlled by at least one electrical motor controlling an endless screw actuating a sector secured to each of said swinging abutments, so as to have only a limited number of points of friction;
- the arithmetic roughness is obtained with the help of microgrooves in the rough flanks, said microgrooves being disposed on the one hand perpendicular to the direction of losses and on the other hand parallel to each other;
- the operating clearance is of the order of 0.02 mm and the arithmetic roughness is of the order of 0.2 mm;
- the two blades have different dimensions to generate two different toric volumes.

The invention relates to a pump, characterized by the fact that it comprises at least one machine according to the invention.

The invention also relates to a compressor, characterized by the fact that it comprises at least one machine according to the invention.

Finally, the invention relates to a hydraulic, pneumatic or thermal external combustion engine or motor, characterized by the fact that it comprises at least one machine according to the invention.

By combination of the operating clearances and of the arithmetic rugosity, is meant:

- the operating clearances between the moving pieces relative to each other are defined by generally standardized machining tolerances, these clearances exist and are necessary;
- the surface of a machined piece is always more or less rough, which in certain cases requires grinding between the two elements operating relative to each other, this roughness can be measured mechanically to be then expressed in microns, which is the arithmetic roughness, and hydraulically, in this latter case there is attributed to it a coefficient of pressure drop;
- with reference to article A 1870 titled "Fluid mechanics", by Jean GOSSE, Doctor of Science and Honorary Professor at the Conservatoire des Arts et Métiers, published in April 1996 in Techniques de l'Ingénieur, paragraph 7.54, entitled "Influence of the roughness of the surface", there is a ratio between the height of the asperities and the thickness of the viscous sub-layer of the fluid, which has been verified experimentally, the friction is increased by the roughness, such that beyond a certain roughness the viscous sub-layer will no longer exist. In section 9, he deals with pressure drop.

It is thus possible to create turbulences in a narrow passage, these said turbulences forming because of the desired sealing, the narrow passage resulting from the operating clearance and the turbulences resulting from the roughness which gives rise to pressure drops.

Thus, by way of example, when an operating clearance rises to 0.02 mm and the arithmetic rugosity to 0.2 mm, the turbulences generate pressure drops which, as a function of the upstream pressures, can be sufficient to obtain the desired sealing.

The accompanying drawings are given by way of example and are not limiting of the invention. They show only an embodiment of the invention and permit easy understanding.

DETAILED DESCRIPTION OF THE INVENTION

The figures are explained in a more detailed manner in the following paragraphs.

Figure 1:
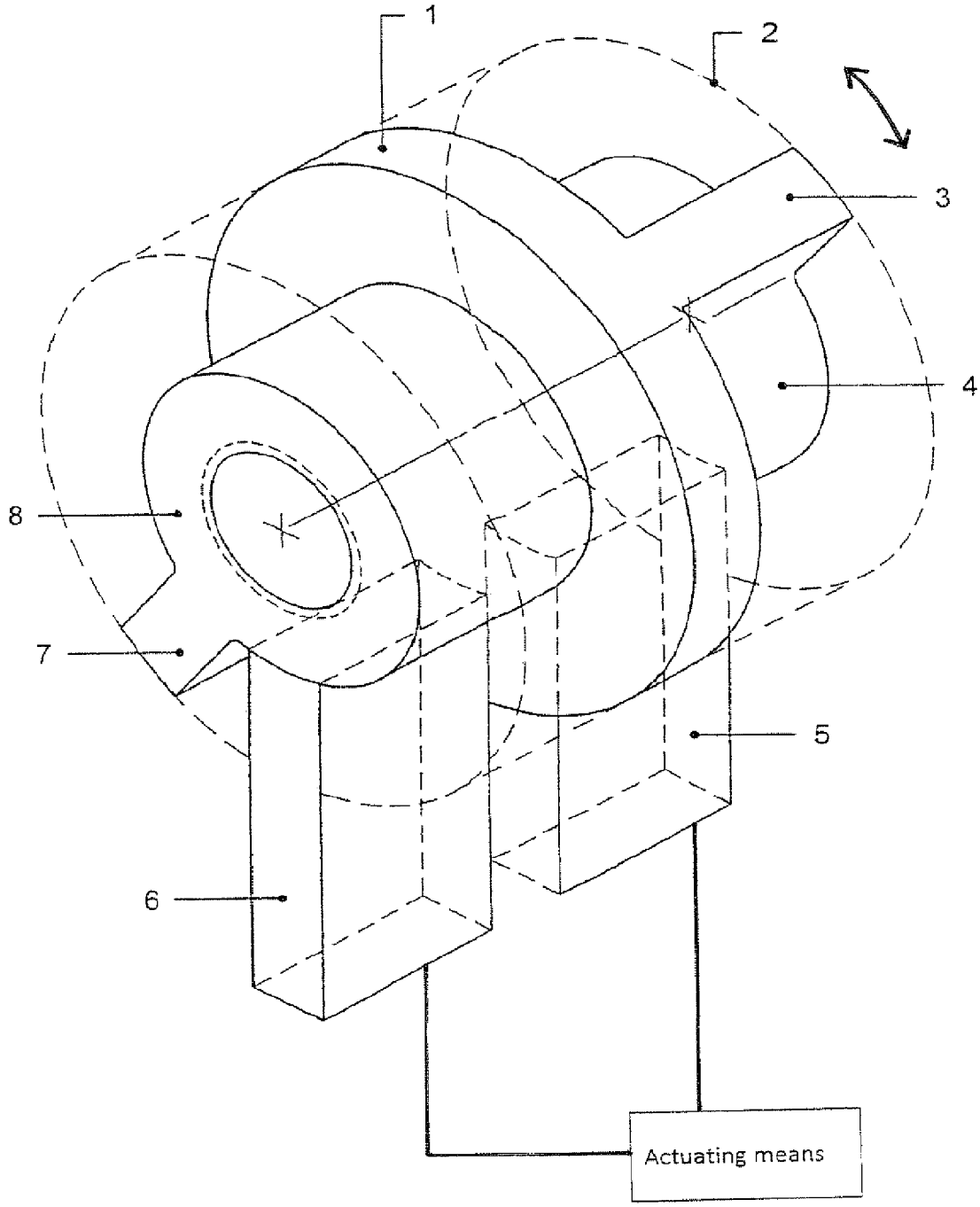
FIG. 1: An isometric perspective view of the rotor, the two basic abutments and the cylindrical chamber shown in broken lines.

With reference to FIG. 1, the rotor is comprised by a disc (1), by two concentric shoulders (4 and 8) disposed on opposite sides of said disc and by two fixed blades (3 and 7) disposed diametrally opposite and on opposite sides of said disc each against one surface of said disc and secured to the periphery of said shoulders, so as to obtain an assembly that is balanced in rotation, said rotor being machined from a single piece or made with the help of assembled components, said rotor being disposed in a cylindrical chamber (2) provided in a stator, the abutments (5 and 6) are disposed in the stator, movable and actuated by mechanical or hydraulic or pneumatic or electrical actuating means or by a combination of said means disposed remotely from said cylindrical chamber, such that the working volume will be free from any type of lubrication and can operate dry and at high temperature, so as to permit the continuous rotation of said rotor, said abutments being positioned very near said shoulders during the working phase, so as to generate variations of volumes between said veins or blades and said abutments and retracted into said stator, to permit the passage of said veins or blades from one side to the other of said abutments.

The volume swept by the revolution of the blades (3, 7) or torus is not necessarily of square or rectangular cross-section as shown. In particular, a circular cross-section is envisagable. The parts of the present device are adaptable as a function of the cross-section of the torus.

Figure 2:
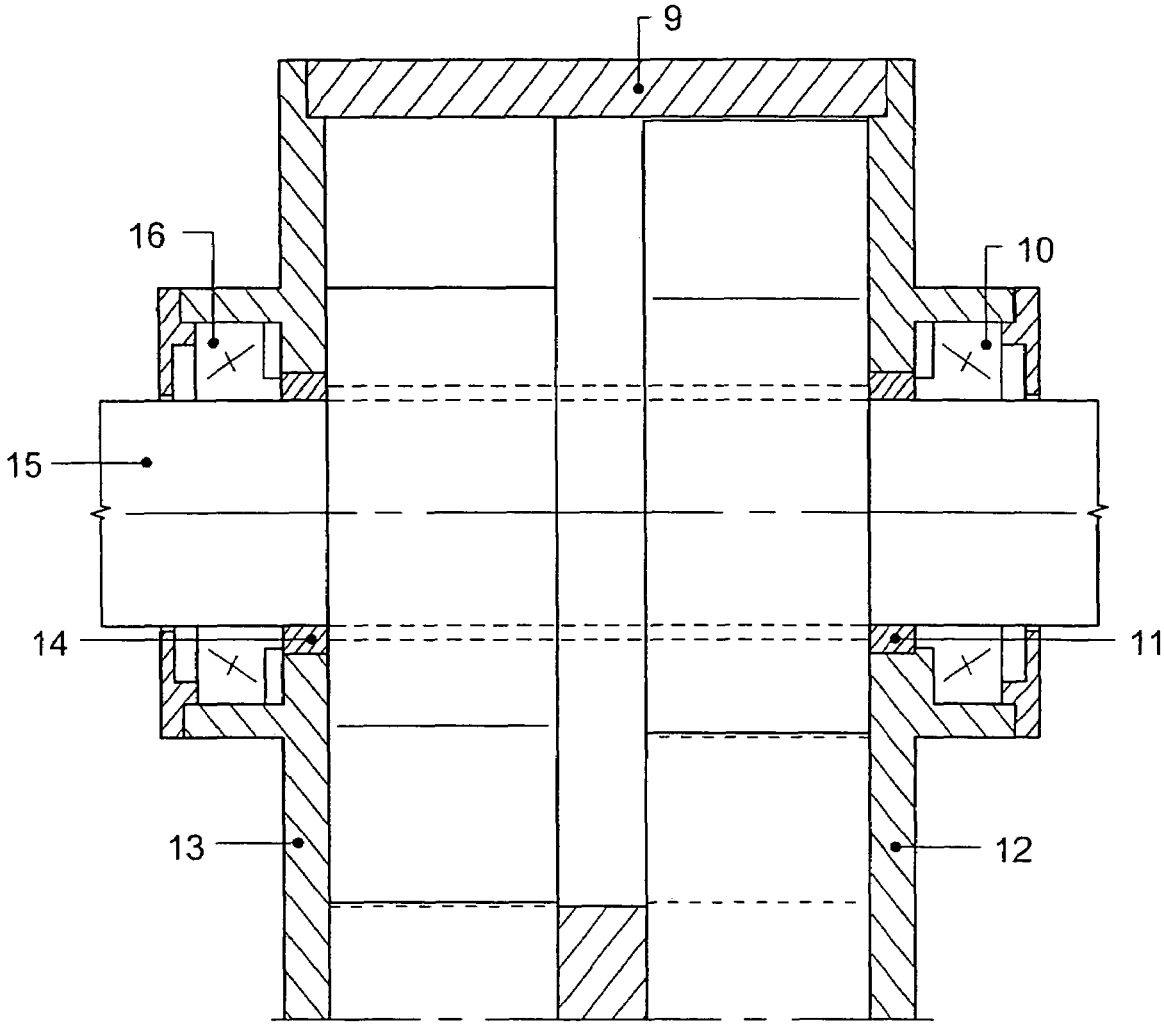
FIG. 2: Axial cross-sectional view of the basic machine in which the X and Y scales are not proportional so as not to have to turn the sheet during reading.

With reference to FIG. 2, the rotor is secured to a shaft (15) and positioned axially on the one hand between the covers of the stator (12 and 13) secured to the stator (9) and on the other hand between the roller bearings (10 and 16) with the help of partitions (11 and 14) whose length is defined according to the specification such that the rotor can turn without entering into contact with said covers. The roller bearings are the only points requiring lubrication.

Generally speaking, the sealing is obtained in an optimal manner because:

- in combination, the dimensions of the surfaces of the rotor associated with the surfaces of the stator, the dimensions of the surfaces of the abutments associated with the surfaces of the rotor and the stator, the clearance between the surfaces of the rotor and the surfaces of the associated stator, the clearance between the surfaces of the abutments and the surfaces of the associated rotor and stator, the arithmetic roughness of all the associated surfaces, are defined such that they generate turbulence in said clearances permitting obtaining a sealing by controlled pressure drop so as not to have either friction or need for lubrication in these places, by way of example, when the operating clearance rises to 0.02 mm (39) and the arithmetic roughness to 0.2 mm (40 and 41), the turbulences generate pressure drops which, as a function of the upstream pressures, can be seen to be sufficient to obtain the required sealing;
- the ridges which define the periphery of said different surfaces are left sharp or are only slightly rounded, as is usually done in factories so as not to have cutting edges, to disturb the passage of the fluids in these clearances.

Figure 3:
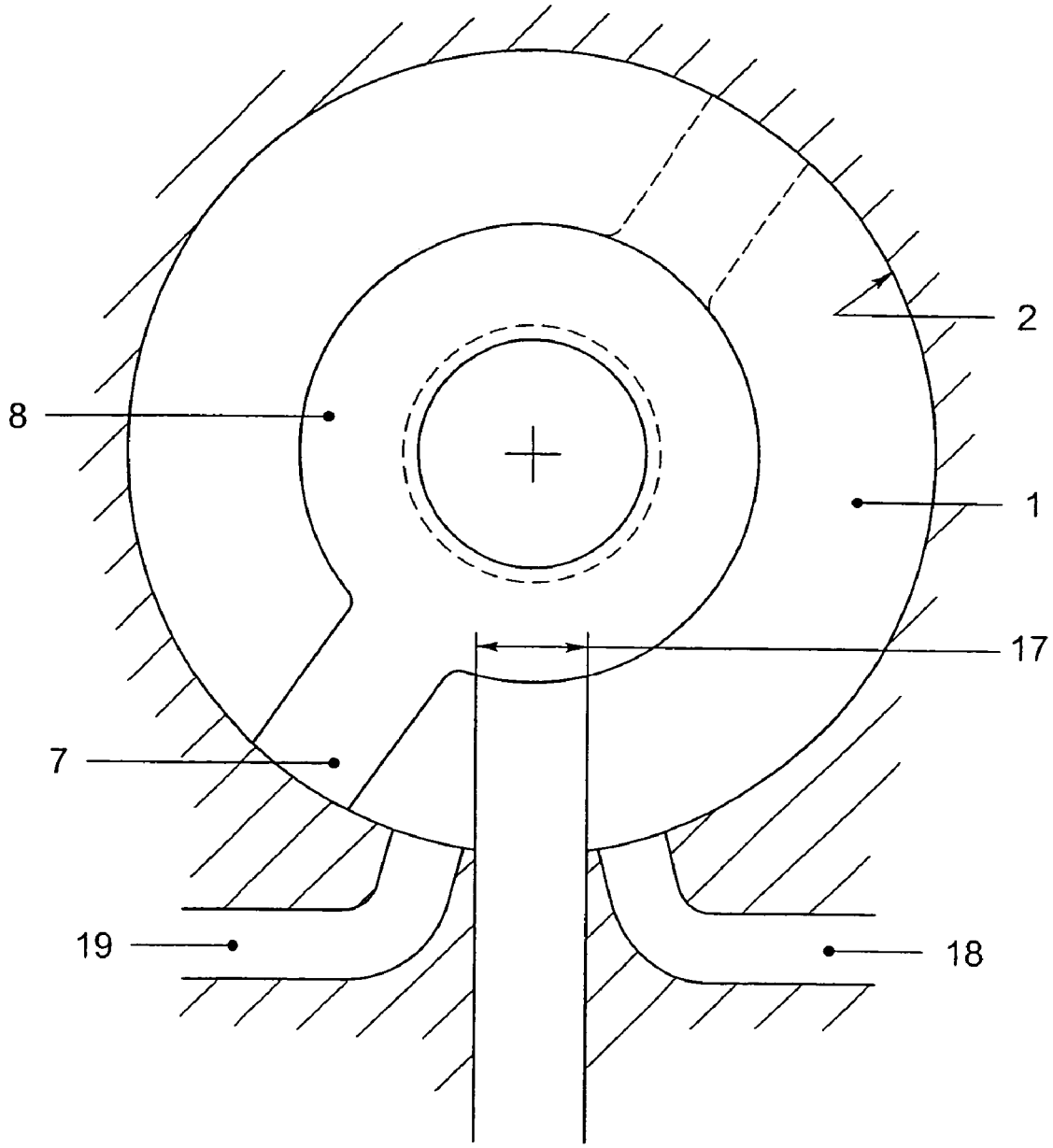
FIG. 3: Axial cross-sectional view of the basic machine, the rotor being positioned at 235° in the positive direction and the forward abutment being in the extended position.

With reference to FIG. 3, which is an axial cross-sectional view of the basic machine, the rotor is positioned at 235° in the positive direction and the forward abutment is in the extended position. The thickness (17) of the abutment (5, 6) forms a part of the characteristics which define the sealing. The conduits (18 and 19) serve for the admission or withdrawal according to the direction of rotation.

Figure 4:
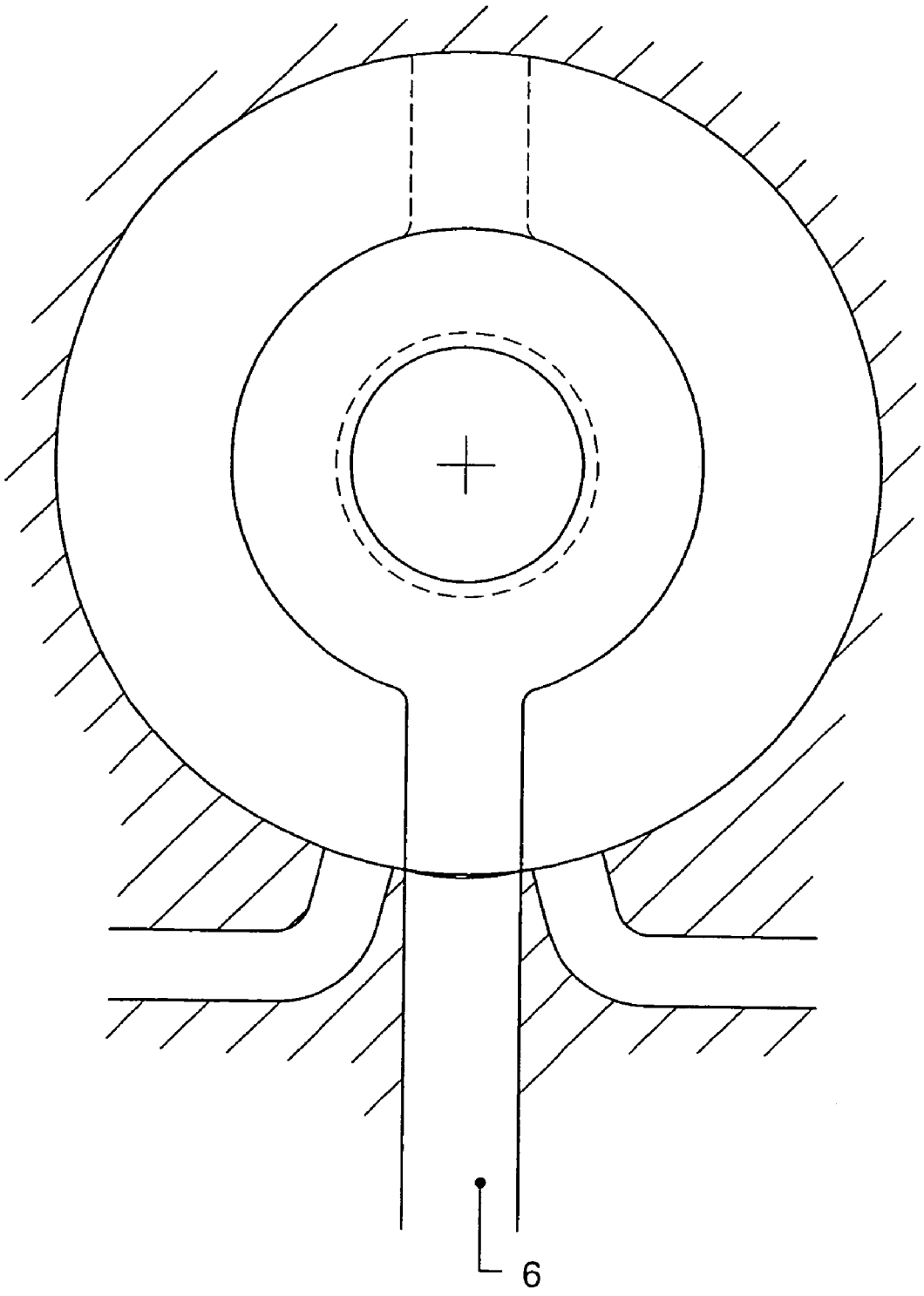
FIG. 4: Axial cross-section of the basic machine, the rotor being positioned at 270° in the positive direction and the forward abutment being in the retracted position.

With reference to FIG. 4, which is an axial cross-sectional view of the basic machine, the rotor is positioned at 270° in the positive direction and the abutment (6) is in the retracted position in the rotor to permit continuous rotation of the rotor.

Figure 5:
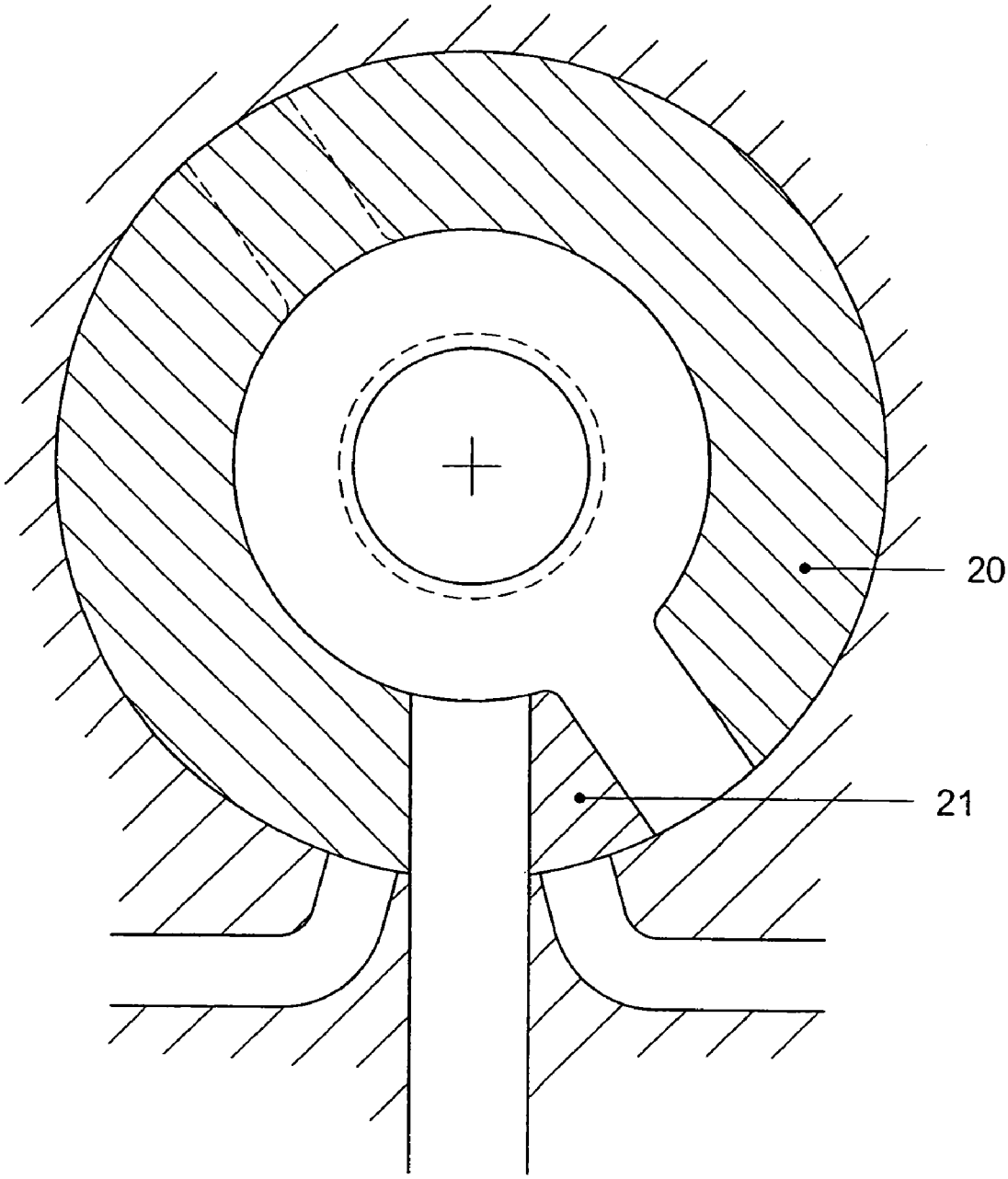
FIG. 5: Axial cross-sectional view of the basic machine, the rotor being positioned at 325° in the positive direction and the front abutment being in the extended position, the volume ratio is represented by cross-hatching.

With reference to FIG. 5, which is an axial cross-sectional view of the basic machine, the rotor is positioned at 325° in the positive direction and the abutment is in the extended position, the ratio of the volumes is represented by cross-hatching: the volume (20) is much greater than the volume (21), which is due to the fact that there is but one blade per shoulder.

Figure 6:
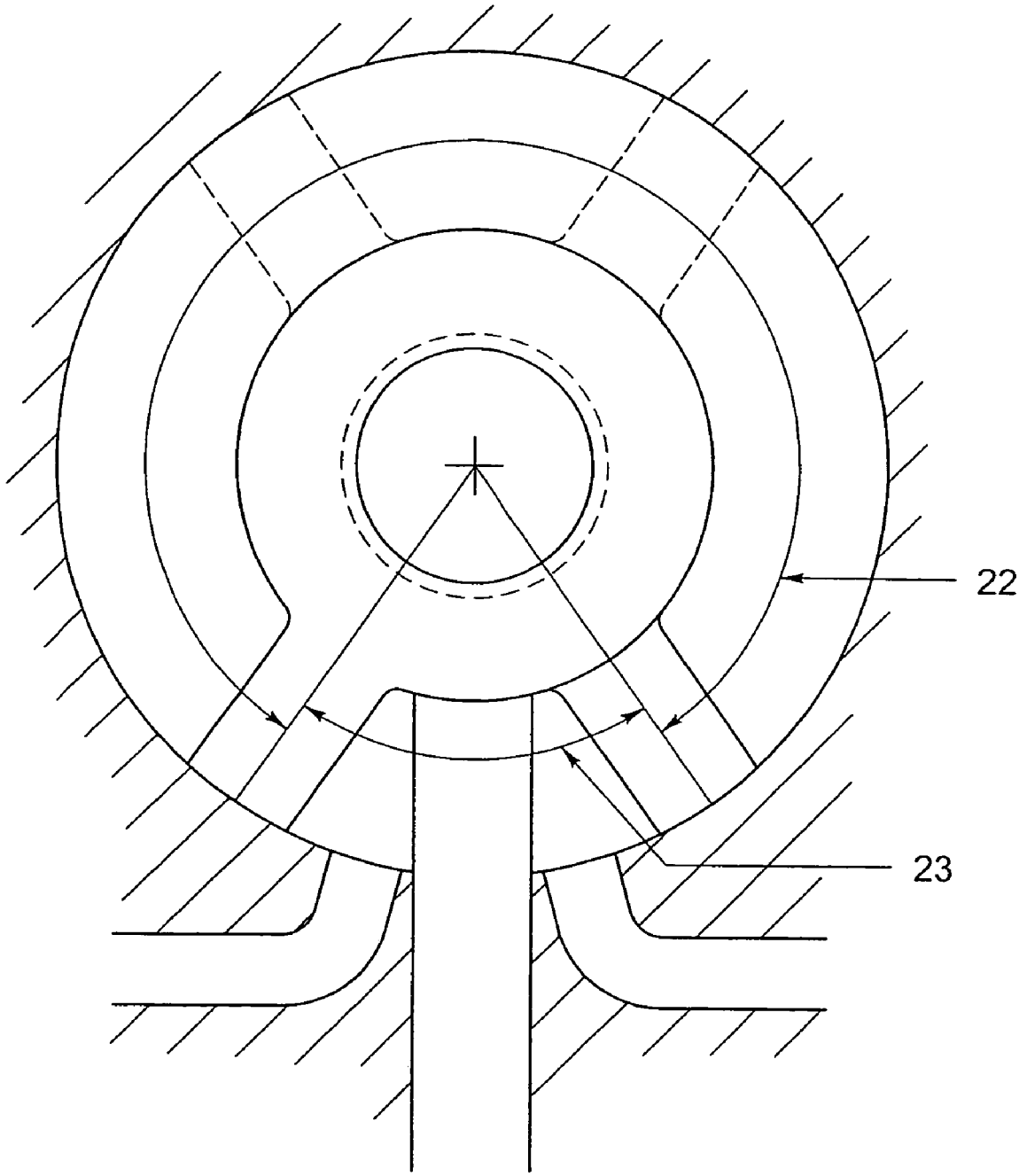
FIG. 6: Axial cross-sectional view of the basic machine, the rotor being positioned at 235° and at 325° in the positive direction and the forward abutment in the extended position to express the useful angle of rotation and the dead time angle.

With reference to FIG. 6, which is an axial cross-sectional view of the basic machine, the rotor is positioned at 235° and at 325° in the positive direction and the forward abutment in the retracted position to express the useful angle of rotation (22) and the dead time angle (23). The above-mentioned large volume (20) is the sum of volume generated by an arc of a circle of 360°=2π, minus a volume equal to the sum of the small volume (21) and of the volume of the blade.

Figure 7:
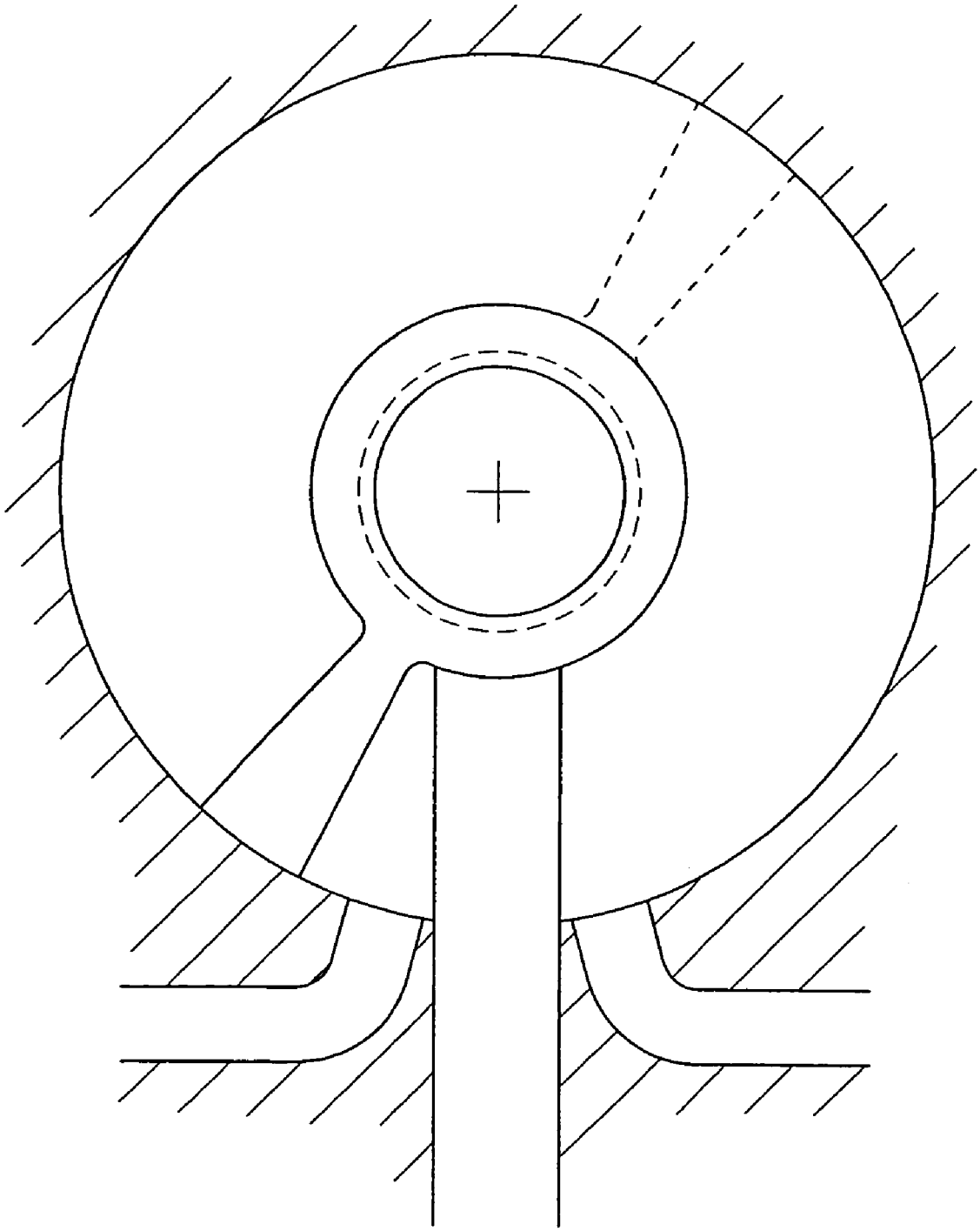
FIG. 7: Axial cross-sectional view of a modified rotor.

With reference to FIG. 7, which is an axial cross-sectional view of a modified rotor, the crown of the shoulder is the diminished external diameter whilst the flanks of the blade are directed toward the axis of the rotor.

Figure 8:
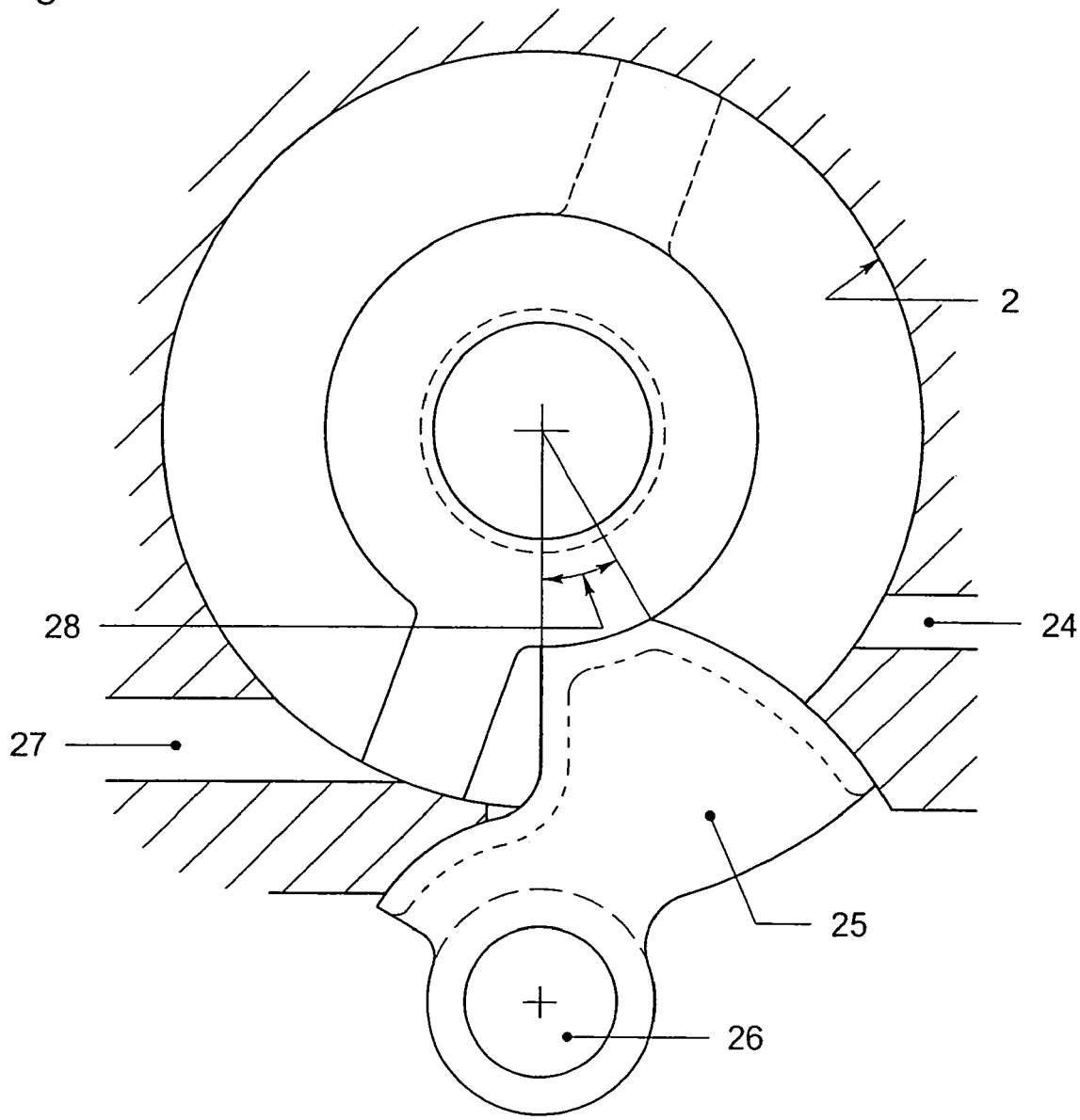
FIG. 8: Axial cross-section of the machine, the rotor being positioned at 250° in the positive direction and the articulated abutment in the extended position.

With reference to FIG. 8, which is an axial cross-sectional view of the machine, the rotor is positioned at 250° in the positive direction and the articulated abutment (25) is in the extended position. These abutments (25) are carried by an axle (26) disposed remotely from said cylindrical chamber (2) so as to be able to be controlled by mechanical or hydraulic or pneumatic or electrical means or by a combination of said means disposed remotely from said cylindrical chamber, such that the working volume will be free from any form of lubrication and can run dry and at high temperature, the articulation of said abutment about said axis can thus be lubricated independently without influence between the said cylindrical chamber. Because of this configuration, the channel (24) is better adapted to carry high pressures, whilst the channel (27) is better adapted to carry low pressures. The angle (28) of the arc of a circle defining the width of the sealed area between the shoulder and the swinging abutment is comparable, to that bearing reference (17). Said axle can also take part in the positioning of the covers relative to the stator.

Figure 9:
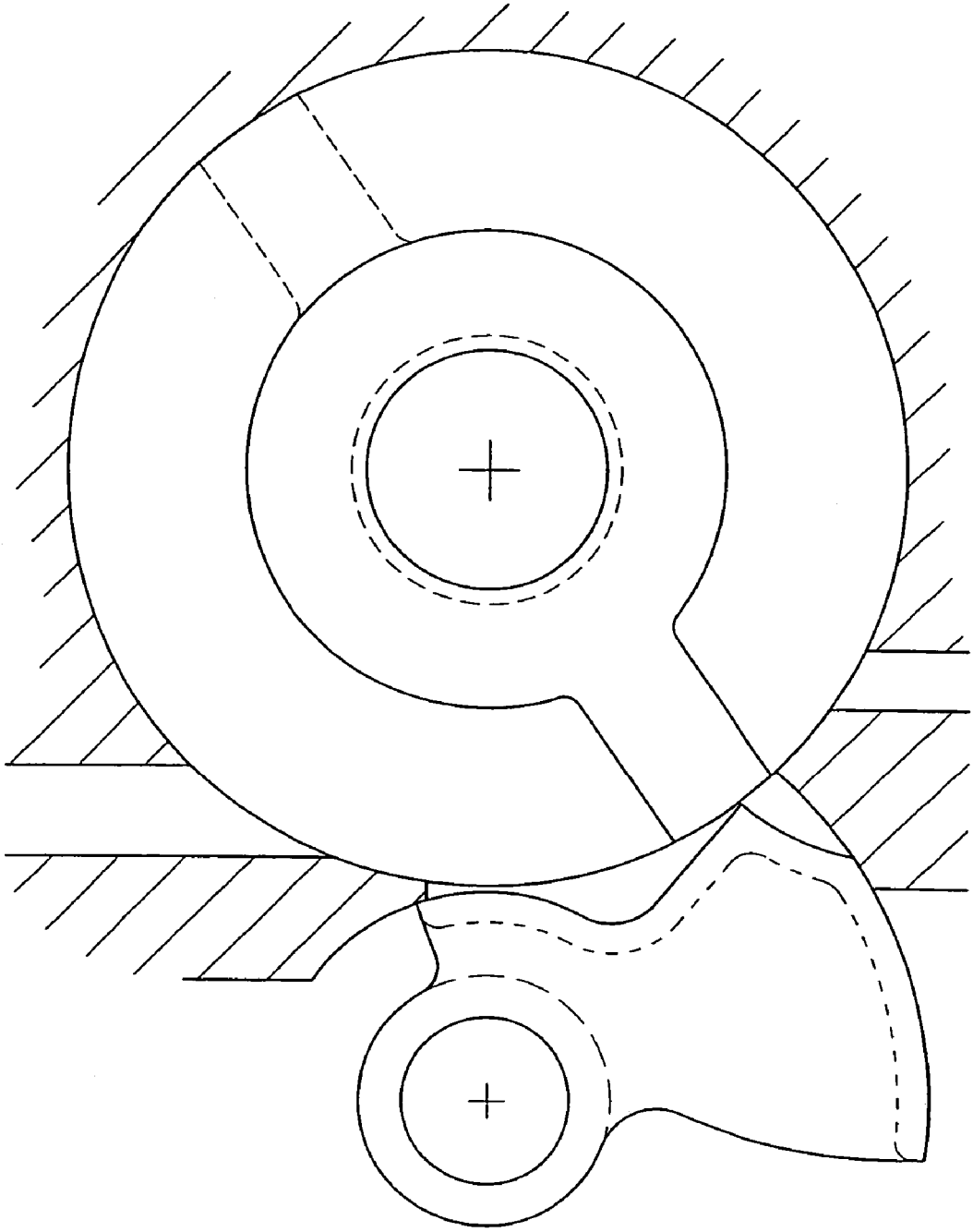
FIG. 9: Axial cross-sectional view of the machine, the rotor being positioned at 305° in the positive direction and the articulated abutment in the retracted position.

With reference to FIG. 9, which is an axial cross-sectional view of the machine, the rotor is positioned at 305° in the positive direction and the articulated abutment (25) is in retracted position.

Figure 10:
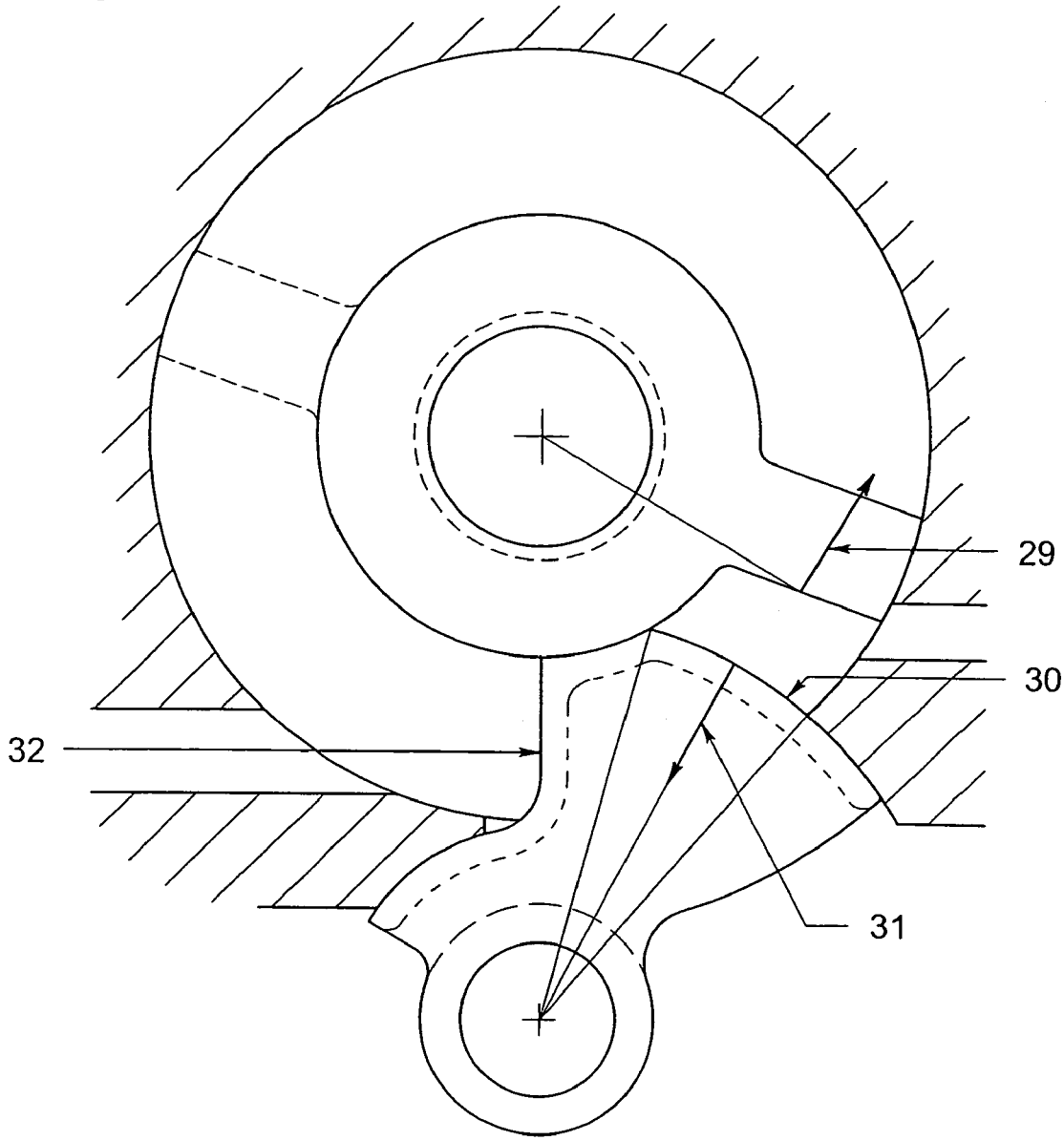
FIG. 10: Axial cross-sectional view of the machine, the rotor being positioned at 350° in the positive direction and the articulated abutment in the extended position.

With reference to FIG. 10, which is an axial cross-sectional view of the machine, the rotor is positioned at 350° in the positive direction and the articulated abutment (25) in extended position. When the rotor turns in the positive direction and this machine operates as a motor, there is produced a couple represented by the arrow (29) whilst the bearing pressure gives rise to a reaction represented by the arrow (31) of equal length. The force is always directed toward the center of the axle (26). As the surface (30) of the abutment (25) can withstand a greater load than the surface (22), it follows that it is on this side that said channel adapted to carry the high pressures must be located.

Figure 11:
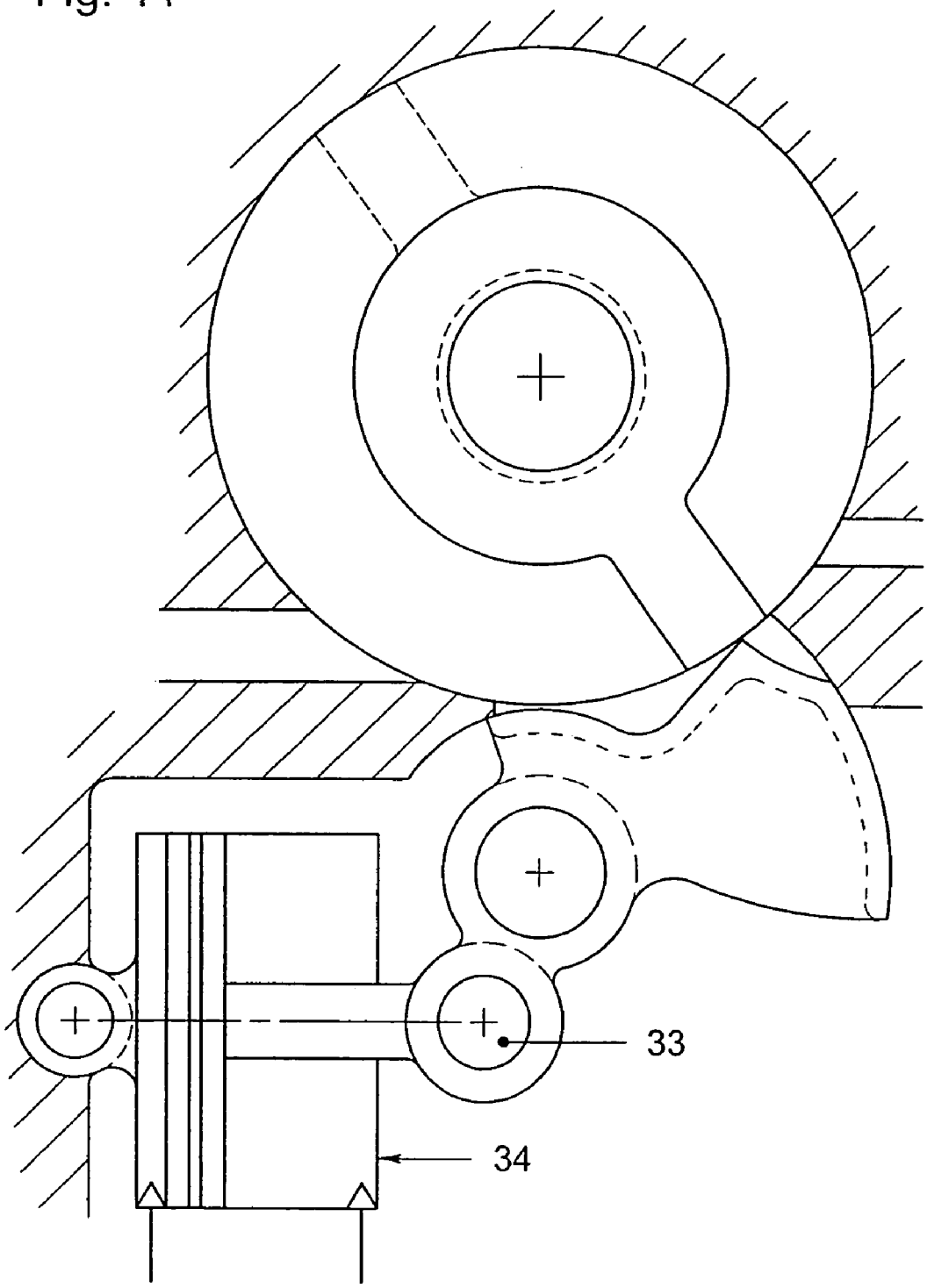
FIGS. 11 and 12: Axial cross-sectional views of the machine. Each articulated abutment is controlled by a hydraulic or pneumatic jack.

With reference to FIG. 11, which is an axial cross-sectional view of the machine, each abutment (25) is articulated and controlled by a hydraulic or pneumatic jack (34) articulated in the stator (9) to be able to follow the curve of the arc of circle defined by the angular movement of its point of securement (33) on said swinging abutment (25), so as to limit the number of points of friction. Here, the jack (34) and the abutment (25) are retracted to permit the passage of the blade (3, 7). The number of points to be lubricated rises to three, hence, by counting the two said roller bearings, it rises to five, all located remotely from the working volume.

Figure 12:
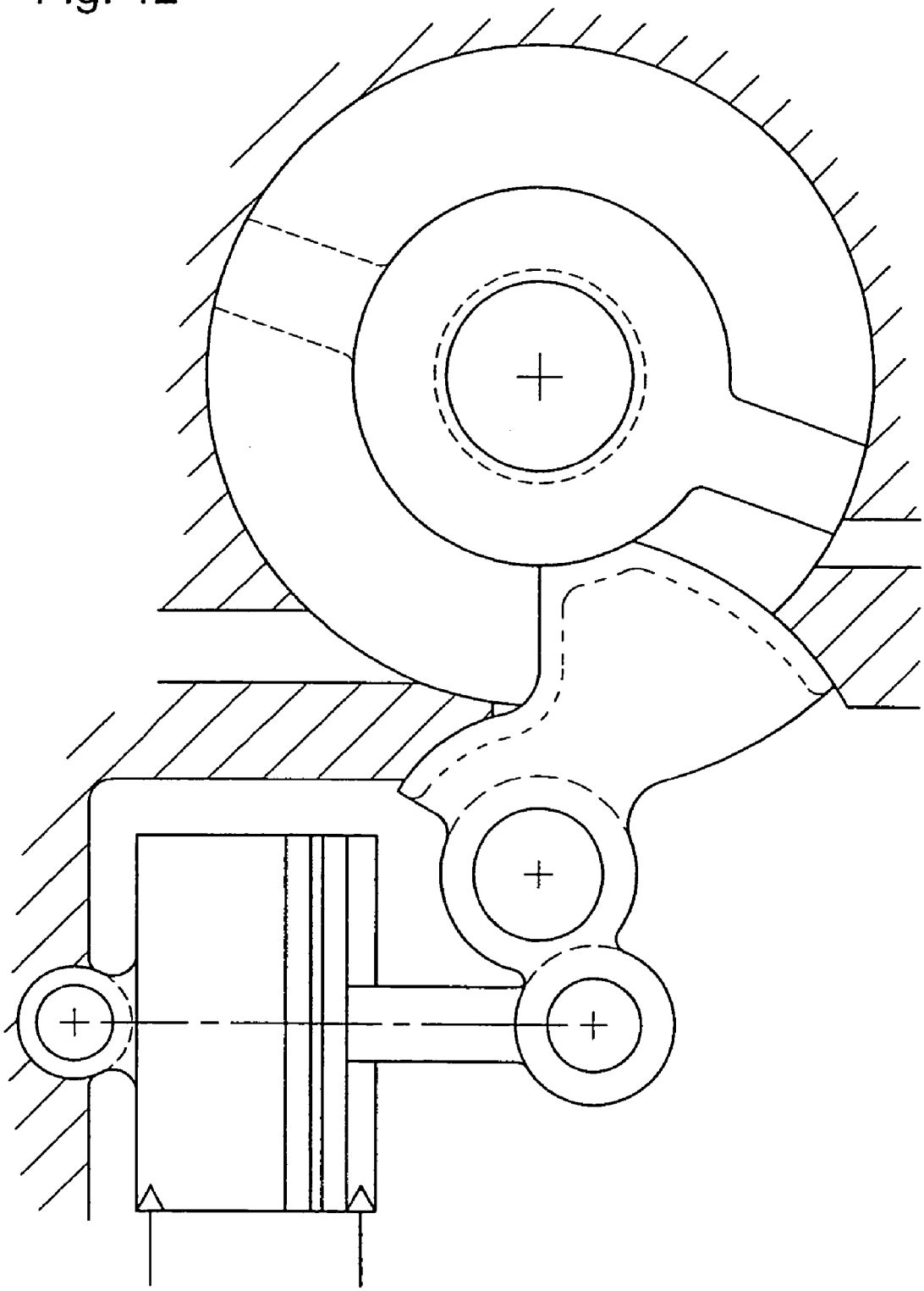

With reference to FIG. 12, which is an axial cross-sectional view of the machine, the jack (34) and the abutment (25) are extended to permit variation of the volumes.

Figure 13:
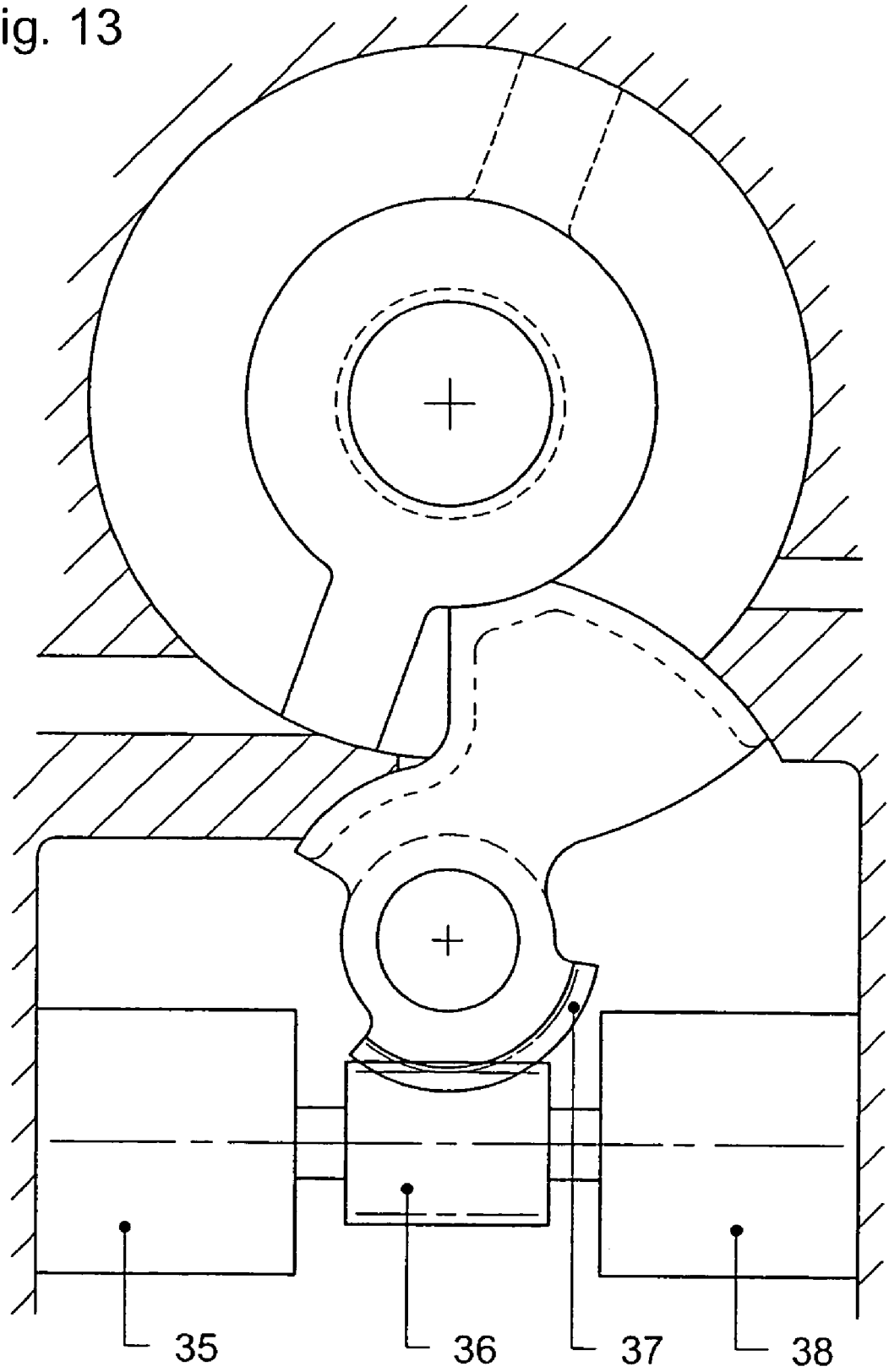
FIGS. 13 and 14: Axial cross-sectional views of the machine. Each articulated abutment is controlled by at least one electric motor controlling the articulated abutment with the help of an endless screw and a toothed sector.

With reference to FIG. 13, which is an axial cross-sectional view of the machine, each swinging abutment is controlled by at least one electric motor (35, 38) controlling an endless screw (36) actuating a sector (37) secured to each of said swinging abutments (25). Here, the abutment (25) is expanded. The forces are balanced when two electric motors are used. Given the points to be lubricated within electric motors, the number of points to be lubricated rises to two. Counting the two said roller bearings, it rises to four, all located remotely from the working volume.

Figure 14:
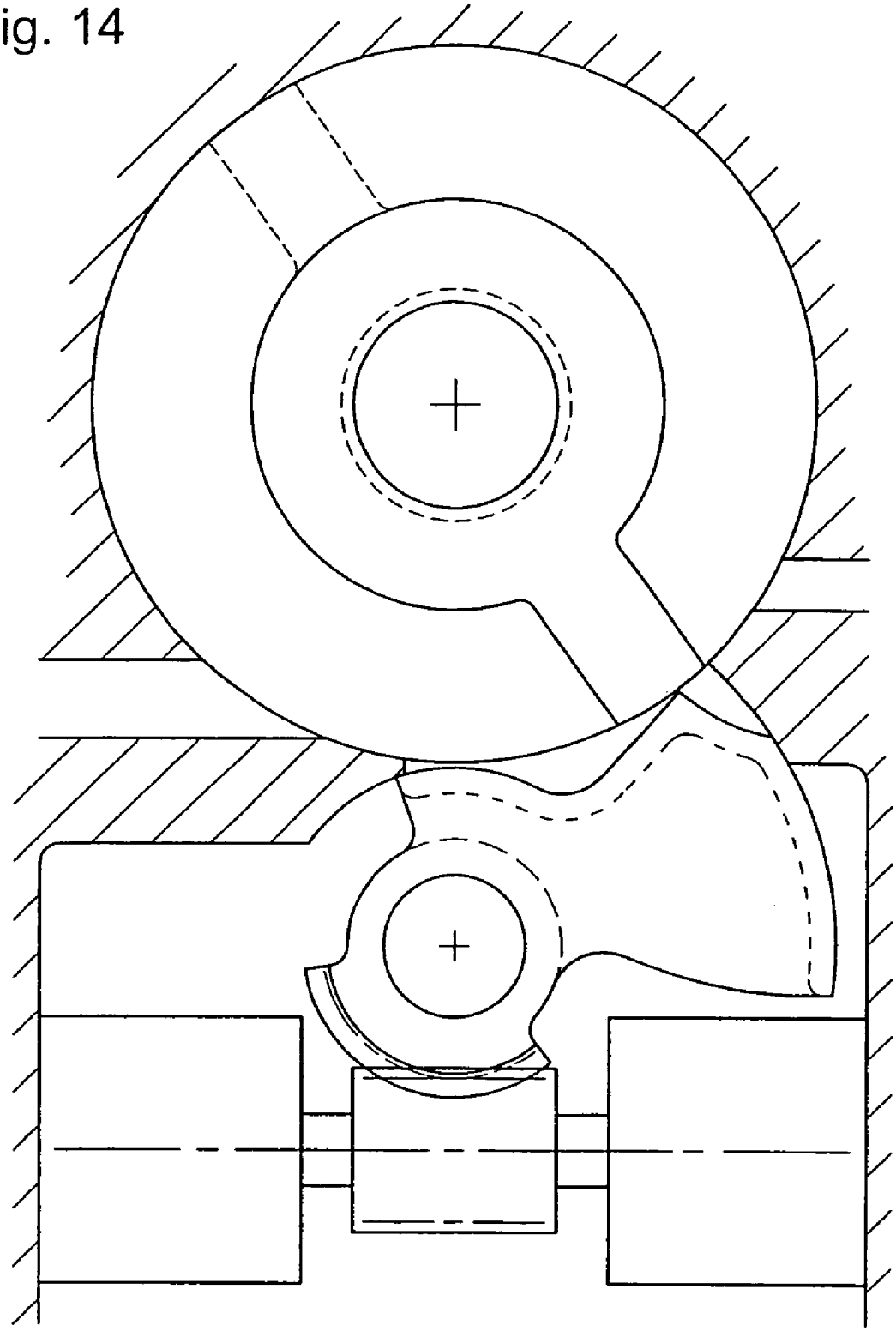

With reference to FIG. 14, which is an axial cross-sectional view of the machine, the swinging abutment (25) is retracted.

Figure 15:
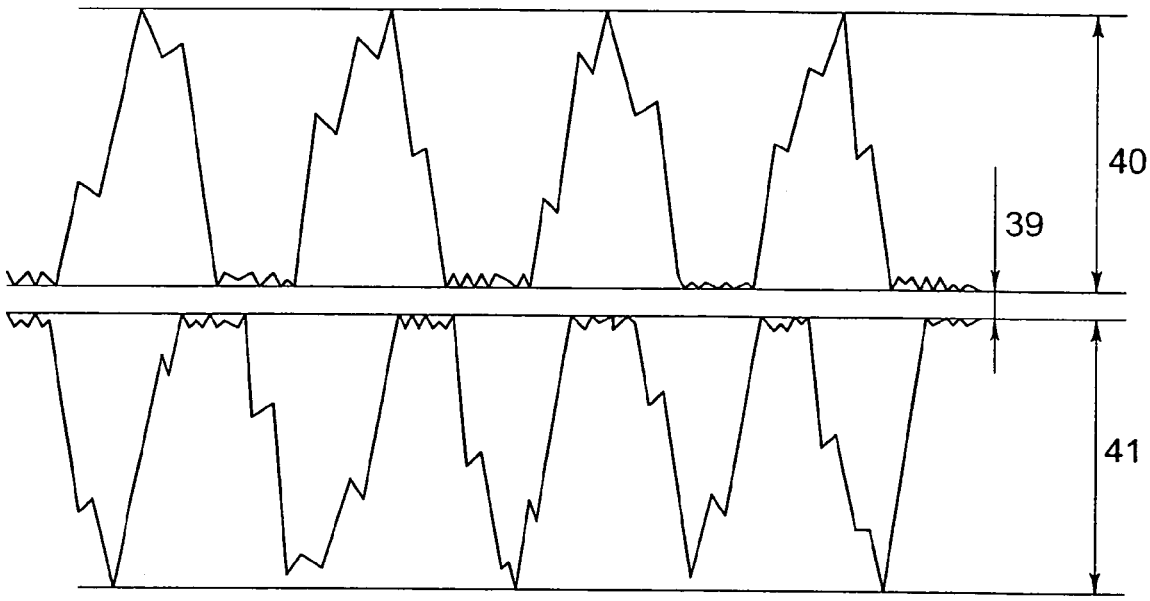
FIG. 15: Microscopic cross-sectional view of two components facing each other.

With reference to FIG. 15, the operating clearances (39) are defined such that the shape characteristics and dimensions can be measured in a conventional manner whilst the roughness of the confronting surfaces (40 and 41) is defined such that the turbulences generated give rise to the required sealing, the hydraulic diameters here being also measured in a conventional manner.

Figure 16:
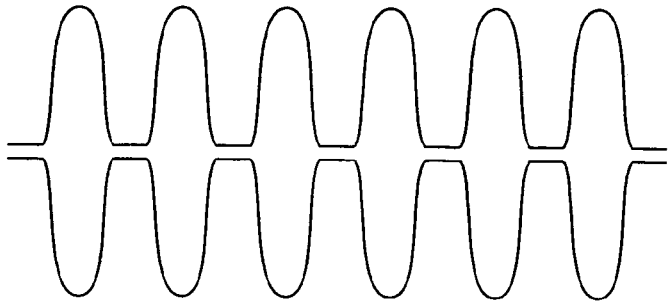
FIG. 16: Cross-sectional view of two facing components in which microgrooves have been machined.

Generally speaking, this is valid for all the figures, this machine can moreover be characterized:

- in that the arithmetic roughness is obtained with the help of microgrooves on the rough flanks (FIG. 16), said microgrooves being disposed on the one hand perpendicular to the direction of loss and on the other hand parallel to each other,
- in that it is applied to the production of pumps or compressors,
- in that it is applied to the production of hydraulic or pneumatic or thermal external combustion motors.

This machine is adapted to the production of groups comprised by two or more of said common shaft machines, if desired of different sizes.

In such an arrangement, one of the covers (12 or 13) can be replaced by a partition separating the different working volumes, the number of partitions being defined by the number of working volumes.

By way of example:

- a group is formed with two or more different said cylinder machines to operate as a staged compressor;
- a group is formed by two machines with different cylinders, one to operate as a compressor and the other as an expander in an assembly forming an external combustion heat motor. In this case, it is necessary to provide a separate combustion chamber and at least one heat exchanger, without counting the indispensable accessories.

According to a modification of the invention, the two blades of a machine of the invention can have different dimensions, so as to generate two different torii of different volumes.

Example: a machine is comprised by two torii of different volumes, the small to operate as a compressor and the large to operate as an expander. This method permits among other things the production of heat motors with very small cylinders.

It is thus preferable to proceed such that the dimensions of the configuration "shoulder-blades" permits obtaining an assembly that is balanced in rotation.

Figure 17:
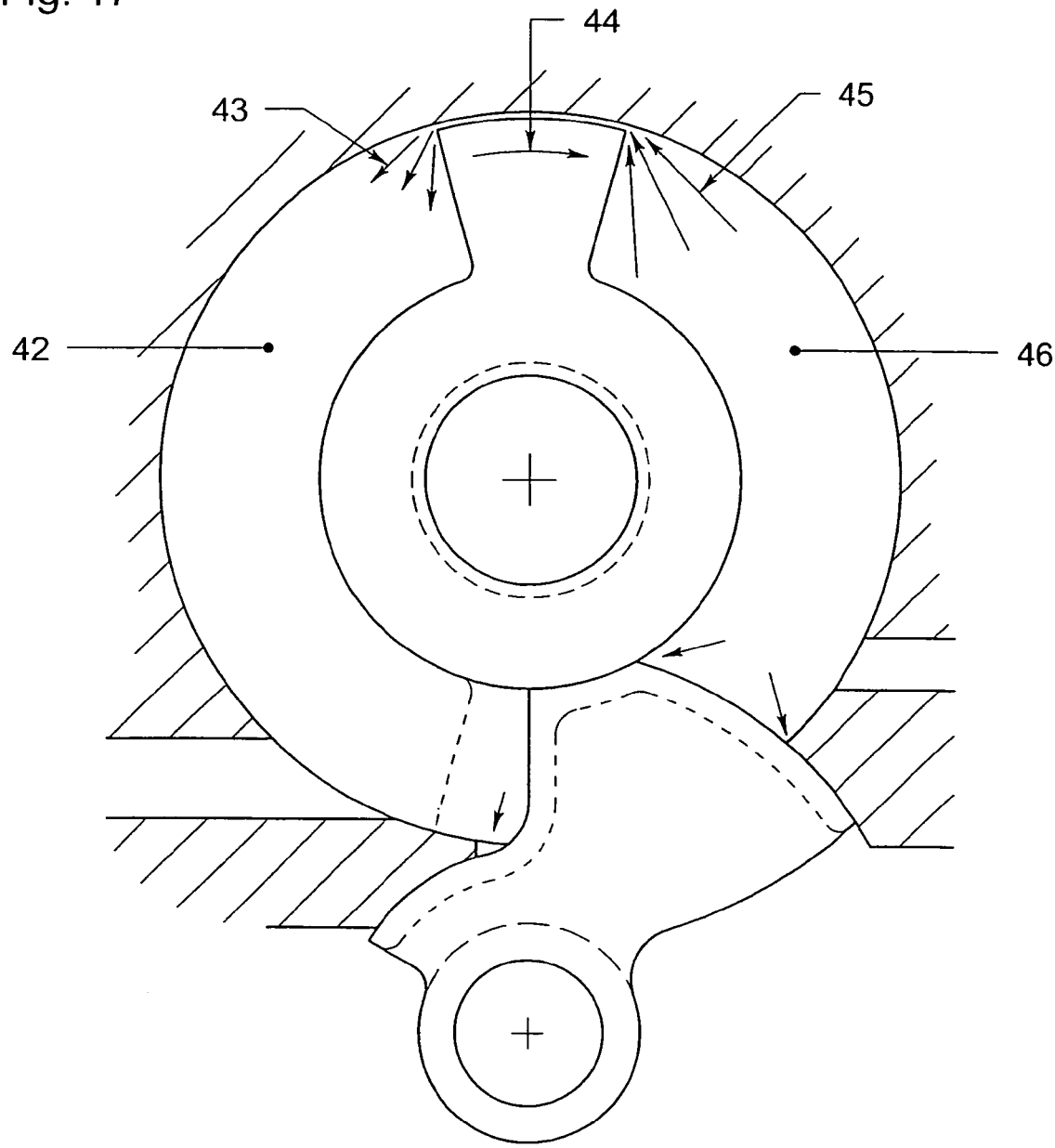
FIG. 17: Schematic view of the loss in a pump or a compressor.

FIG. 17 shows the losses that take place at the level of the blade (3, 7) in the case of application to a pump or a compressor: the suction pressure (42) is lower than atmospheric pressure, there is thus a vacuum. The pressure (46) is greater than atmospheric pressure either because it is necessary to overcome friction, or because it is desired to obtain a pressure on this side of the blade. The tolerated losses will compensate the vacuum (42).

Figure 18:
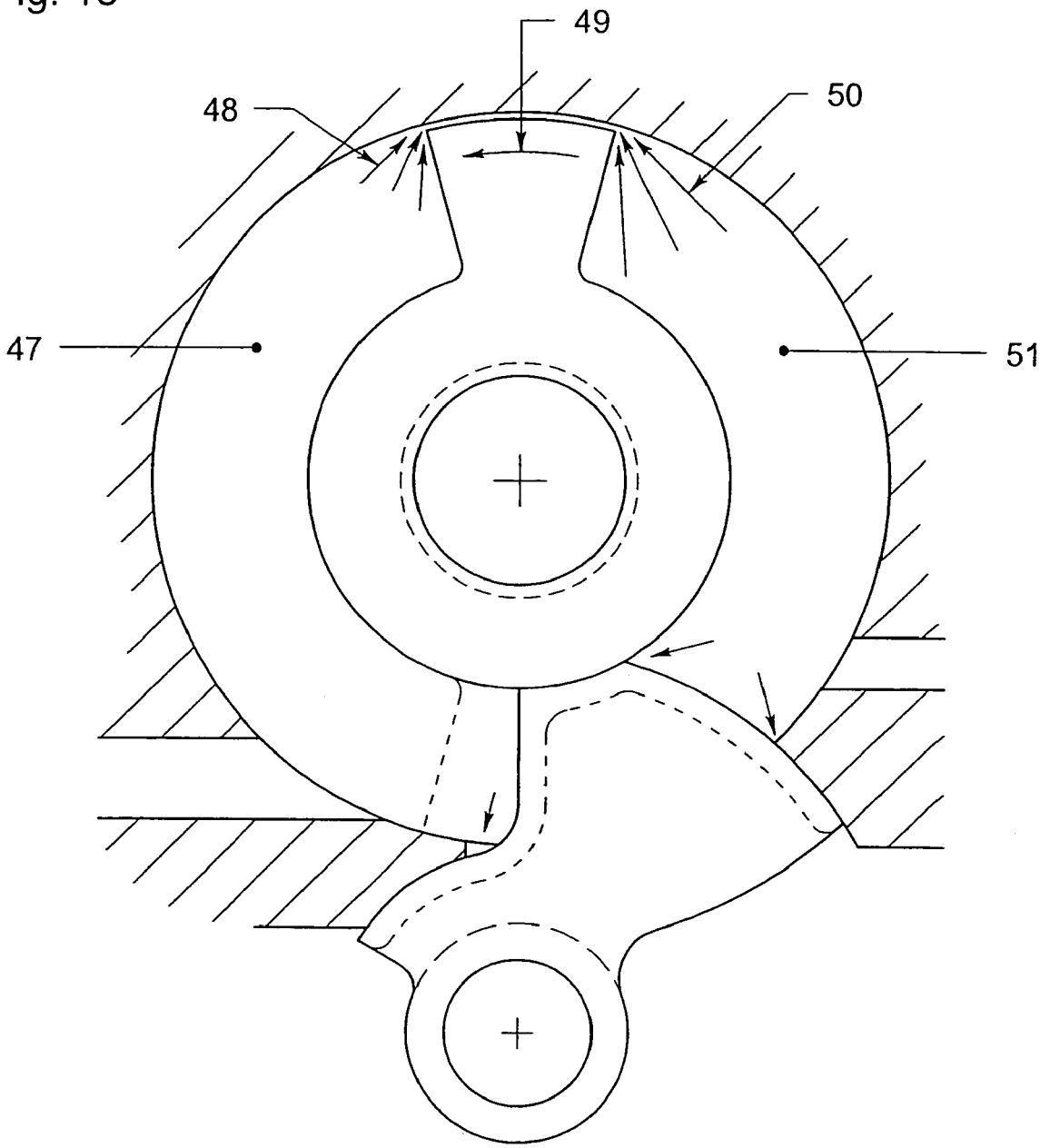
FIG. 18: Schematic view of the loss in a pneumatic or hydraulic motor or thermal internal combustion motor.
Figure 19:
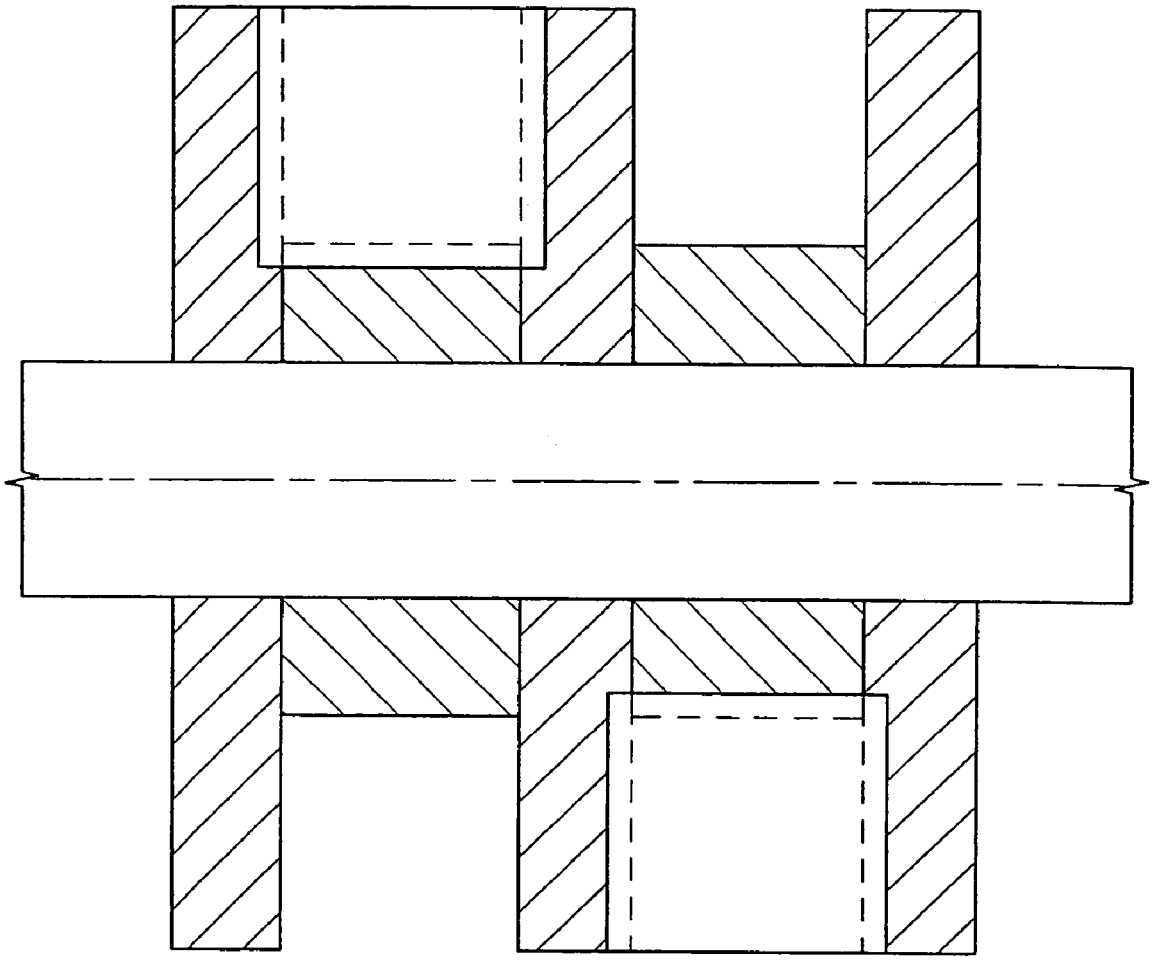
FIG. 19: Schematic view of a rotor constituted by assembled elements, each rotor being thus closed on the three sides not involved in the location of its abutment.
Figure 20:
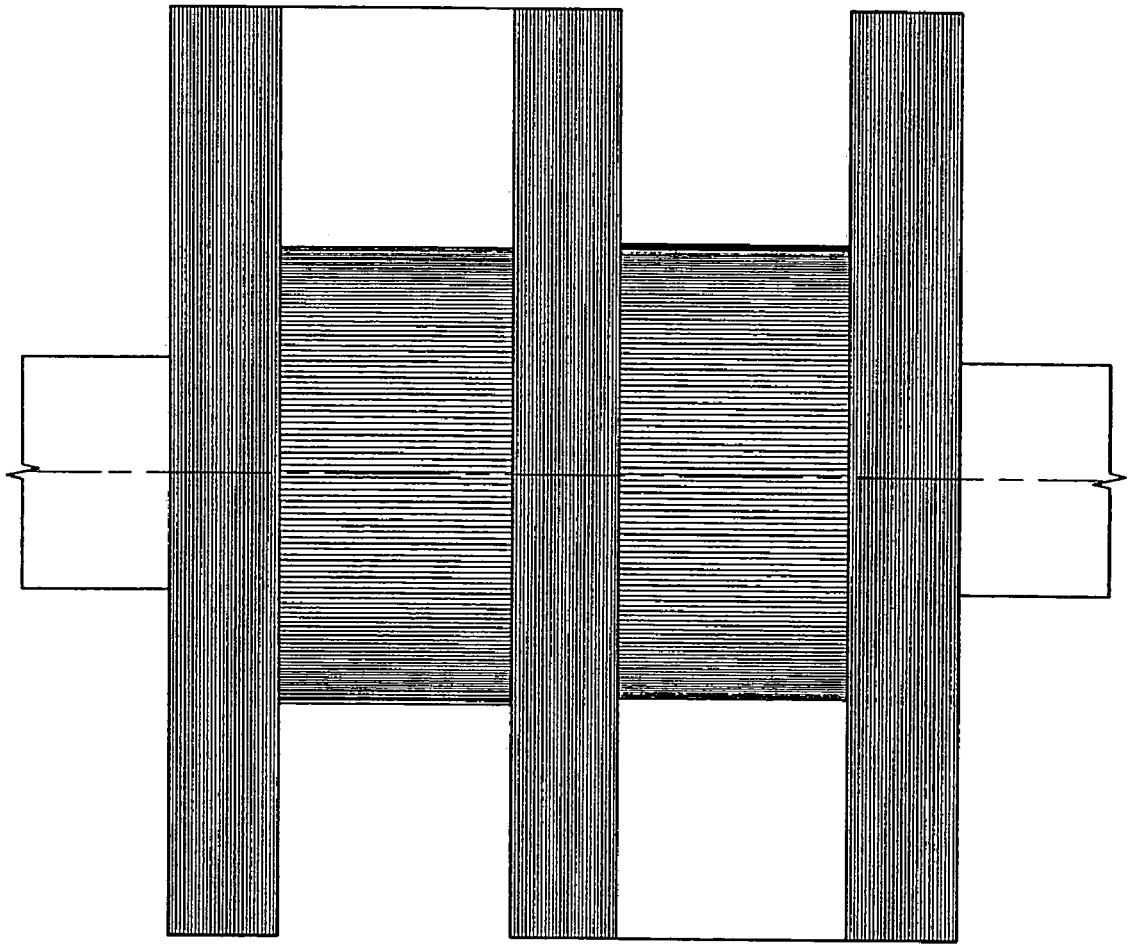
FIG. 20: Representation of the perpendicular position of the microgrooves to the direction of loss.

FIG. 18 shows the losses that take place at the level of the blade (3, 7) in the case of application to a hydraulic or pneumatic motor: the pressure (51) is greater than atmospheric pressure because it is desired to generate a motor couple. The pressure (47) is greater than atmospheric pressure because it is necessary to overcome the friction due to outflow. The losses will be entirely or partially balanced on the two sides of the blade.

Finally, the portions of the rotor and/or stator (9) in relative movement can be constituted (or covered) by a self-lubricating material to overcome accidental friction (for example in the case of the presence of impurities or according to the nature of the fluid present in the volume of the cylindrical chamber (2)).

REFERENCES

1—Rotor disc.
2—Working cylinder.
3 and 7—Blades.
4 and 8—Shoulders.
5 and 6—Abutments.
9—Stator.
10 and 16—Roller bearings.
11 and 14—Crosspieces.
12 and 13—Stator covers.
15—Shaft.
17—Width of the sealed area between a shoulder and an abutment.
18 and 19—Channels for inlet and outlet defined by the direction of rotation.
20—Greater volume of suction or delivery.
21—Smaller volume of suction or delivery.
22—Useful angle of rotation.
23—Dead time angle of rotation.
24—High pressure channel.
25—Swinging abutment.
26—Rotation axle of the abutment (25).
27—Low pressure channel.
28—Angle of the arc of a circle defining the width of the sealing area between a shoulder and an abutment.
29—Direction of the possible motor couple.
30—External side of the swinging abutment.
31—Direction of application of the reaction to the possible motor couple.
32—Lateral side of the swinging abutment.
33—Articulation axle.
34—Hydraulic or pneumatic jack.
35 and 38—Electric motors.
36—Endless screw.
37—Wheel sector for endless screw.
39—Operating clearance.
40 and 41—Arithmetic roughness.
42—Vacuum due to suction.
43—Direction of compensatory losses.
44—Negative direction of rotation.
45—Direction of losses in delivery or compression.
46—Delivery or compression pressure.
47—Delivery pressure.
48—Direction of balancing losses.
49—Direction of positive rotation.
50—Direction of expansion losses.
51—Driving pressure.

The invention claimed is:

1. A rotary volumetric machine comprising a stator (9) in which a cylindrical chamber (2) is provided, a rotor disposed in the cylindrical chamber (2) and secured to a shaft (15), blades (3, 7) formed on the rotor, and abutments (5, 6, 25) movable by actuating means between:

a position extended into the volume of the cylindrical chamber (2) during the working phase so as to generate variations of volume between the blades (3, 7) and the abutments (5, 6);

a retracted position within the stator (9) to permit the passage of the blades (3, 7) from one side to the other of the abutments (5, 6, 25), wherein:

the rotor comprises a disc (1), two concentric shoulders (4, 8) disposed on opposite sides of said disc (1) and two fixed blades (3, 7) disposed diametrically opposed on opposite sides of said disc (1) each against a surface of said disc (1) and secured to the periphery of a shoulder (4, 8) so as to obtain an assembly that is balanced in rotation;

in the extended position inside the volume of the cylindrical chamber (2), the abutments (5, 6, 25) are positioned adjacent but out of contact with the shoulders, (4, 8); and the rotor is positioned axially on the one hand between the covers of the stator (12 and 13) secured to the stator (9) and on the other hand between roller bearings (10 and 16) with the help of crosspieces (11 and 14) whose length is defined such that the rotor turns without contacting said covers.

2. The rotary volumetric machine of claim 1, wherein:

the dimensions of the surfaces of the rotor associated with the surfaces of the stator (9), the dimensions of the surfaces of the abutments (5, 6, 25) associated with the surfaces of the rotor and of the stator (9), the clearance between the surfaces of the rotor and the surfaces of the associated stator (9), the clearance between the surfaces of the abutments (5, 6, 25) and the associated surfaces of the rotor and of the stator (9), the arithmetic roughness of all the associated surfaces, are defined such that they generate turbulences in said clearances permitting obtaining a sealing by controlled pressure drop so as not to have either friction nor the need for lubrication at those places.

3. The rotary volumetric machine of claim 2, wherein:

the arithmetic roughness is obtained with the help of microgrooves on the rough flanks, said microgrooves being disposed on the one hand perpendicular to the direction of loss and on the other hand parallel to each other.

4. The rotary volumetric machine of claim 1, wherein:

ridges which define the periphery of said different surfaces are left sharp or are only slightly rounded to disturb the passage of the fluids in said clearances.

5. The rotary volumetric machine of claim 1, wherein:

the actuating means for the movable abutments (5, 6, 25) are disposed remotely from the cylindrical chamber (2).

6. The rotary volumetric machine of claim 5, wherein:

the abutments (25) are carried by an axle (26) disposed remotely from said cylindrical chamber (2), they swing under the action of actuating means, such that the bearing pressure (31) will be borne by said axle (26), the external side (30) being preferably that of the high pressures and the lateral side (32) that of the low pressures, the articulation of said abutment (25) about said axle (26) being thus adapted to be lubricated independently without influence at the interior of said cylindrical chamber (2).

7. The rotary volumetric machine of claim 6, wherein:

each swinging abutment (25) is controlled by a hydraulic or pneumatic jack (34) articulated in the stator (9) to be able to follow the curve of the arc of a circle defined by the angular displacement of its securement point (33) on said swinging abutment (25), so as to limit the number of points of friction.

8. The rotary volumetric machine of claim 6, wherein:

each swinging abutment (25) is controlled by at least one electrical motor (35, 38) controlling an endless screw (36) actuating a sector (37) secured to each of said swinging abutments (25), so as to maintain only a limited number of points of friction.

9. The rotary volumetric machine of claim 1, wherein:

the two blades (3, 7) have different dimensions to generate two different toric volumes.

10. A pump comprising at least one machine according to claim 1.

11. A compressor comprising at least one machine according to claim 1.

12. A hydraulic, pneumatic or external combustion heat motor, comprising at least one machine according to claim 1.

13. A rotary volumetric machine comprising a stator (9) in which a cylindrical chamber (2) is provided, a rotor disposed in the cylindrical chamber (2) and secured to a shaft (15), blades (3, 7) formed on the rotor, and abutments (5, 6, 25) movable by actuating means between:

a position extended into the volume of the cylindrical chamber (2) during the working phase so as to generate variations of volume between the blades (3, 7) and the abutments (5, 6);

a retracted position within the stator (9) to permit the passage of the blades (3, 7) from one side to the other of the abutments (5, 6, 25), wherein:

the rotor comprises a disc (I), two concentric shoulders (4, 8) disposed on opposite sides of said disc (1) and two fixed blades (3, 7) disposed diametrically opposed on opposite sides of said disc (1) each against a surface of said disc (1) and secured to the periphery of a shoulder (4, 8) 50 as to obtain an assembly that is balanced in rotation;

in the extended position inside the volume of the cylindrical chamber (2), the abutments (5, 6, 25) are positioned adjacent but out of contact with the shoulders, (4, 8);

the dimensions of the surfaces of the rotor associated with the surfaces of the stator (9), the dimensions of the surfaces of the abutments (5, 6, 25) associated with the surfaces of the rotor and of the stator (9), the clearance between the surfaces of the rotor and the surfaces of the associated stator (9), the clearance between the surfaces of the abutments (5, 6, 25) and the associated surfaces of the rotor and of the stator (9), the arithmetic roughness of all the associated surfaces, are defined such that they generate turbulences in said clearances permitting obtaining a sealing by controlled pressure drop so as not to have either friction nor the need for lubrication at those places; and the operating clearance is of the order of 0.02 mm and the arithmetic roughness is of the order of 0.2 mm.

* * * * *